US009095240B2

(12) United States Patent
Bowen

(10) Patent No.: US 9,095,240 B2
(45) Date of Patent: Aug. 4, 2015

(54) TOWEL WITH ARM CHANNELS

(71) Applicant: Off Coast Products, Inc., Palm Harbor, FL (US)

(72) Inventor: James Ryan Bowen, Oldsmar, FL (US)

(73) Assignee: Off Coast Products, Inc., Palm Harbor, FL (US)

( * ) Notice: Subject to any disclaimer, the term of this patent is extended or adjusted under 35 U.S.C. 154(b) by 0 days.

(21) Appl. No.: 14/102,837

(22) Filed: Dec. 11, 2013

(65) Prior Publication Data

US 2014/0165254 A1 Jun. 19, 2014

Related U.S. Application Data

(60) Provisional application No. 61/738,550, filed on Dec. 18, 2012.

(51) Int. Cl.

| | |
|---|---|
| ***A41D 3/08*** | (2006.01) |
| ***A47K 10/02*** | (2006.01) |
| *A41D 7/00* | (2006.01) |

(52) U.S. Cl.

CPC ..... *A47K 10/02* (2013.01); *A41D 7/008* (2013.01); *A41D 7/006* (2013.01)

(58) Field of Classification Search

CPC ..... A41D 3/08; A41D 7/008; A41D 7/006; A41D 7/00; A41D 15/04; A41D 3/00; A41B 13/06; A45F 4/12; A47K 10/02

USPC ..... 5/482, 494, 495; 2/88, 89

See application file for complete search history.

(56) References Cited

U.S. PATENT DOCUMENTS

| | | | | | |
|---|---|---|---|---|---|
| 197,346 | A | * | 11/1877 | Denneler | 2/88 |
| 243,330 | A | * | 6/1881 | Upham | 2/59 |
| 278,727 | A | * | 6/1883 | Morrison | 2/88 |
| D45,010 | S | * | 12/1913 | Lanier | D2/739 |
| 1,285,917 | A | * | 11/1918 | Bradley et al. | 2/91 |
| 1,670,405 | A | * | 5/1928 | Green | 2/88 |
| 1,990,568 | A | * | 2/1935 | Scheidler | 15/222 |
| 2,154,227 | A | * | 4/1939 | Brown | 2/74 |
| 2,213,754 | A | * | 9/1940 | Thirring | 280/810 |
| 3,013,797 | A | * | 12/1961 | Schwartz | 2/88 |
| 4,062,076 | A | * | 12/1977 | Albertson | 5/482 |
| 4,316,288 | A | * | 2/1982 | Henrickson | 2/88 |
| 4,451,932 | A | * | 6/1984 | Wagemann et al. | 2/80 |
| 4,565,144 | A | * | 1/1986 | Ricci | 112/437 |
| 4,576,155 | A | * | 3/1986 | Levy | 128/869 |
| 5,245,717 | A | * | 9/1993 | Rudy | 5/507.1 |
| D382,756 | S | | 8/1997 | Ryan | |
| 5,873,131 | A | * | 2/1999 | Sabin | 2/69 |

(Continued)

*Primary Examiner* — Alissa L Hoey
*Assistant Examiner* — Jameson Collier
(74) *Attorney, Agent, or Firm* — Larson & Larson, P.A.; Frank Liebenow; Patrick Reid

(57) ABSTRACT

A towel has a linear top edge of a first arm cover affixed to a base sheet at an angle with respect to the top lengthwise edge of the base sheet. A bottom, arced edge of the first arm cover is affixed to the base sheet forming a first arm channel having a first shoulder central of the base sheet and having a first wrist opening proximal to a first edge of the base sheet. A linear top edge of a second arm cover is affixed to the base sheet at an angle with respect to the top lengthwise edge of the base sheet. A bottom, arced edge of the second arm cover is affixed to the base sheet forming a second arm channel that has a second shoulder opening central to the base sheet and a second wrist opening proximal to a second edge of the base sheet.

8 Claims, 4 Drawing Sheets

(56) References Cited

U.S. PATENT DOCUMENTS

| | | | | |
|---|---|---|---|---|
| 5,884,331 | A * | 3/1999 | Barajas | 2/69 |
| 6,006,356 | A * | 12/1999 | Song | 2/69 |
| D422,397 | S * | 4/2000 | Cohen | D2/858 |
| 6,243,873 | B1 * | 6/2001 | Aliff | 2/88 |
| 6,401,249 | B2 * | 6/2002 | Haar et al. | 2/69 |
| 6,450,168 | B1 * | 9/2002 | Nguyen | 128/869 |
| 6,536,049 | B2 * | 3/2003 | Jastrab et al. | 2/88 |
| 6,708,343 | B1 * | 3/2004 | Ceron | 2/88 |
| 6,859,942 | B1 * | 3/2005 | Cratty | 2/88 |
| 7,222,371 | B2 * | 5/2007 | Houghton et al. | 2/88 |
| 7,587,769 | B1 | 9/2009 | McDermott | |
| D618,433 | S * | 6/2010 | Gray et al. | D2/717 |
| D622,482 | S * | 8/2010 | Stein | D2/826 |
| D622,483 | S * | 8/2010 | Stein | D2/826 |
| 7,779,492 | B2 * | 8/2010 | Mangano | 5/482 |
| 8,118,364 | B2 * | 2/2012 | Davis | 297/219.12 |
| 8,468,612 | B1 * | 6/2013 | Galloway | 2/207 |
| D686,802 | S * | 7/2013 | Washington et al. | D2/861 |
| 8,650,664 | B2 * | 2/2014 | Parr | 2/88 |
| 2003/0046763 | A1 * | 3/2003 | Chancey | 5/482 |
| 2004/0093657 | A1 * | 5/2004 | Erinc | 2/69 |
| 2005/0039241 | A1 * | 2/2005 | Khan | 2/86 |
| 2005/0044606 | A1 * | 3/2005 | Flanagan-Frazier | 2/69 |
| 2005/0125895 | A1 * | 6/2005 | Gatten | 5/482 |
| 2006/0117480 | A1 | 6/2006 | Younce | |
| 2006/0200906 | A1 * | 9/2006 | Deering et al. | 5/482 |
| 2007/0006360 | A1 * | 1/2007 | Walker | 2/88 |
| 2008/0028518 | A1 * | 2/2008 | Miotke et al. | 5/482 |
| 2010/0059558 | A1 * | 3/2010 | Robinson et al. | 224/155 |
| 2010/0139001 | A1 * | 6/2010 | Mangano | 5/636 |
| 2010/0146680 | A1 * | 6/2010 | Cuoco | 2/84 |
| 2010/0186166 | A1 * | 7/2010 | Sulentic | 5/494 |
| 2012/0005801 | A1 * | 1/2012 | Parr | 2/84 |

* cited by examiner

TOWEL WITH ARM CHANNELS

CROSS-REFERENCE TO RELATED APPLICATIONS

This application is a non-provisional of U.S. Provisional Patent Application Ser. No. 61/738,550, filed on Dec. 12, 2012. The entire disclosure and contents of the above application is hereby incorporated by reference.

FIELD

This invention relates to the field of blankets and towels and more particularly to a towel having arm slit formed/sewed onto a back surface of the towel.

BACKGROUND

There are many occasions that one wraps a towel or blanket around their shoulders. At home, often after being comfortable under a blanket, one wraps the blanket around their shoulders when getting up to keep warm. Likewise, after a shower, one often wraps a towel around their body to keep warm and continue drying.

At the beach or pool, typically after bathing, one may wrap a towel around their upper torso to dry off as well as keep warm, especially when there is a breeze.

When standing relatively still and not performing other activities, it is often easy to keep a hold on the blanket or towel to keep it from falling off. There are many times when this is not the case. It is not easy to keep the towel or blanket on one's shoulders when performing other operations such as picking up beach paraphernalia, cooking, tending to children, etc. Wrapping of a towel around one's waist is more secure than covering one's shoulders, but wrapping a towel around one's waist does not dry and keep the upper torso warm.

What is needed is a towel/blanket that will stay in place around one's shoulders without occupying the wearer's hands, thereby freeing the wearer's hands to perform other activities.

SUMMARY

In one embodiment, a towel/blanket is disclosed including a base sheet having a top lengthwise edge, a first widthwise edge and a second widthwise edge. A first arm cover has a top edge that is linear. The top edge of the first arm cover is affixed to the base sheet at an angle with respect to the top lengthwise edge of the base sheet. A bottom, arced edge of the first arm cover is affixed to the base sheet thereby forming a first arm channel having a first shoulder opening towards a center of the base sheet and having a first wrist opening proximal to the first widthwise edge of the base sheet. A second arm cover has a top edge that is linear. The top edge of the second arm cover is affixed to the base sheet at an angle with respect to the top lengthwise edge of the base sheet. A bottom, arced edge of the second arm cover is affixed to the base sheet forming a second arm channel that has a second shoulder opening towards the center of the base sheet and having a second wrist opening proximal to the second widthwise edge of the base sheet.

In another embodiment, a method of using a towel is disclosed including providing a towel having a base sheet and two arm covers. The base sheet has a top lengthwise edge, a first widthwise edge and a second widthwise edge. A first arm cover has a top edge that is linear. The top edge of the first arm cover is affixed to the base sheet at an angle with respect to the top lengthwise edge of the base sheet which grows wider towards the first widthwise edge. A bottom, arced edge of the first arm cover is affixed to the base sheet forming a first arm channel having a first shoulder opening towards a center of the base sheet and having a first wrist opening proximal to the first widthwise edge of the base sheet. A second arm cover has a top edge that is linear. The top edge of the second arm cover is affixed to the base sheet at an angle with respect to the top lengthwise edge of the base sheet, the angle growing wider towards the second widthwise edge. A bottom, arced edge of the second arm cover is affixed to the base sheet forming a second arm channel having a second shoulder opening towards a center of the base sheet and having a second wrist opening proximal to the second widthwise edge of the base sheet. The method includes inserting a first arm into the first arm channel through the first shoulder opening so that a hand of the first arm extends through the first wrist opening then inserting a second arm into the second arm channel through the second shoulder opening so that a hand of the second arm extends through the second wrist opening.

In another embodiment, a towel/blanket is disclosed including a base sheet that has a top lengthwise edge, a first widthwise edge and a second widthwise edge. The top lengthwise edge is longer than the first widthwise edge, the top lengthwise edge is longer than the second widthwise edge, and the first widthwise edge being substantially the same length as the second widthwise edge. A first arm cover has a top edge that is linear. The top edge of the first arm cover is affixed to the base sheet at a first distance from the top lengthwise edge of the base sheet nearest to a center of the base sheet and the top edge of the first arm cover is affixed to the base sheet at a second distance from the top lengthwise edge of the base sheet nearest to the first widthwise edge; the first distance is less than the second distance. A bottom, arced edge of the first arm cover is affixed to the base sheet forming a first arm channel that has a first shoulder opening towards the center of the base sheet and a first wrist opening proximal to the first widthwise edge of the base sheet. A second arm cover has a top edge that is linear. The top edge of the second arm cover is affixed to the base sheet at the first distance from the top lengthwise edge of the base sheet nearest to the center of the base sheet and the top edge of the first arm cover is affixed to the base sheet at the second distance from the top lengthwise edge of the base sheet at a point nearest to the first widthwise edge at a point nearest to the second widthwise edge. A bottom, arced edge of the second arm cover is affixed to the base sheet forming a second arm channel having a second shoulder opening towards the center of the base sheet and having a second wrist opening proximal to the second widthwise edge of the base sheet.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
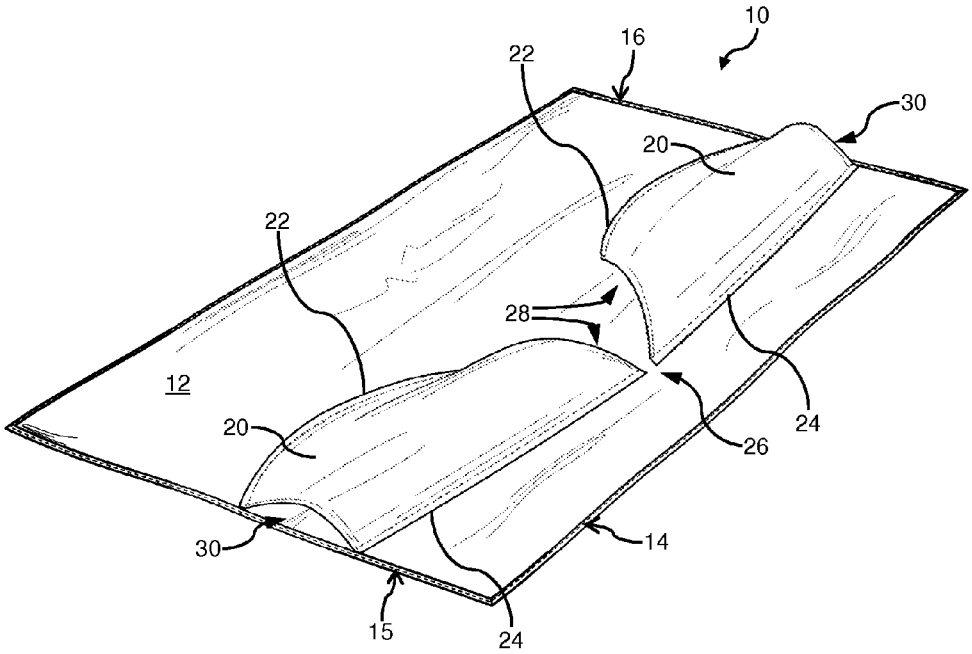
FIG. 1 illustrates a perspective view of a towel/blanket with arm channels.

Reference will now be made in detail to the presently preferred embodiments of the invention, examples of which are illustrated in the accompanying drawings. Throughout the following detailed description, the same reference numerals refer to the same elements in all figures.

Figure 2:
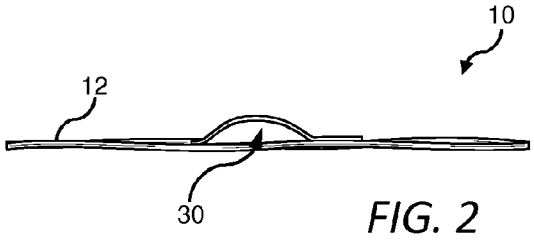
FIG. 2 illustrates a widthwise side plan view of the towel/blanket with arm channels.
Figure 3:
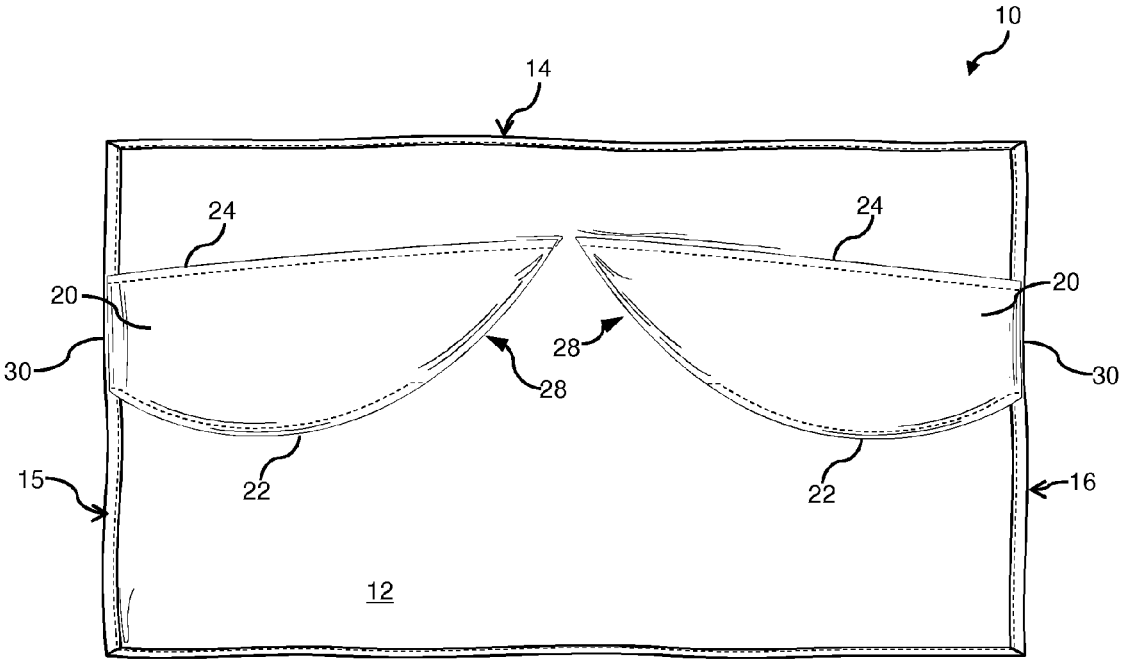
FIG. 3 illustrates a rear plan view of the towel/blanket with arm channels.

Referring to FIGS. 1-3, several views of a towel/blanket 10 with arm covers 20 are shown. The base sheet 12 of the towel/blanket 10 is preferably made of a material that is flexible so as to easily wrap around a person's shoulders or upper torso. Examples of this material are those typically used in fabrication of towels such as cloth, terry cloth, cotton, etc. In some embodiments, other materials are anticipated such as nylon, Mylar, straw mats, etc.

The arm covers 20 are preferably made of a sheet of material that is flexible so as to easily adapt to arms inserted into the arm covers 20. Examples of this material are those typically used in fabrication of towels such as cloth, terry cloth, cotton, etc. In some embodiments, other materials are anticipated such as nylon, Mylar, straw mats, etc. There is no requirement that the arm covers 20 be made of the same material as the base sheet 12 of the towel/blanket 10. In some embodiments, the arm covers 20 are made from the same material as the base sheet 12 of the towel/blanket 10 while in other embodiments, the arm covers 20 are made from a different material as the base sheet 12 of the towel/blanket 10.

In a preferred embodiment, edges of the material of the arm covers 20 attach to the back of the base sheet 12 of the towel/blanket 10 in a substantially linear upper connection 24 and an arced lower connection 22, though any shape of connections 22/24 is also anticipated. Any type of attachment or connection between the material of the arm covers 20 and the back of the base sheet 12 of the towel/blanket 10 is anticipated including, but not limited to, stitching, gluing, hot welding, etc. In some embodiments, the arm channels 20 are fabricated as part of the base sheet 12 of the towel/blanket 10, for example, during the weaving process.

In one embodiment, a top, lengthwise edge 14 of the base sheet 12 is longer than both a first widthwise edge 15 of the base sheet 12 and a second widthwise edge 16 of the base sheet 12. In some embodiments, the first widthwise edge 15 of the base sheet 12 is substantially the same length as the second widthwise edge 16 of the base sheet 12, in that there is no noticeable difference as perceived by the naked eye between the length of the first widthwise edge 15 of the base sheet 12 and the length of the second widthwise edge 16 of the base sheet 12.

The arm covers 20 are wider than the distance between the connections 22/24, thereby forming a channel between the arm covers 20 and the base sheet 12 of the towel/blanket 10. The channels 28/30 are wide enough to accept the arms of a person 40 (see FIGS. 4 and 5).

In the examples shown, the substantially linear upper connection 24 is wider that the arced lower connection 22, forming angled, openings 28 that are larger than the wrist openings 30, making it easier to don. The larger openings 28 also better accommodate the shoulders of the person 40 when the towel/blanket 10 is worn.

Being that both the towel/blanket 10 and the arm channels 20 are made of materials typically used for towels and blankets (e.g. terry cloth, cotton, wool, etc.), the arm covers 20 do not preclude use of the towel/blanket 10 for basically any purpose that a towel/blanket of the prior art is used. For example, anticipated uses for the towel/blanket 10 include drying one's body after showering/bathing, lying upon the towel/blanket 10 at the beach, covering one's body with the towel/blanket 10 when cold, wrapping the towel/blanket 10 around one's body, etc.

Often, one wraps a towel or blanket [of the prior art] around the person's upper body after a shower/bath, after bathing at the beach/pool/hot tub, or just to keep warm. This serves the intended purpose (to keep warm) using towels and blankets of the prior art, but limits freedom of the user to move about and do anything with their hands and arms because doing such often leads to the towel or blanket falling off.

Figure 4:
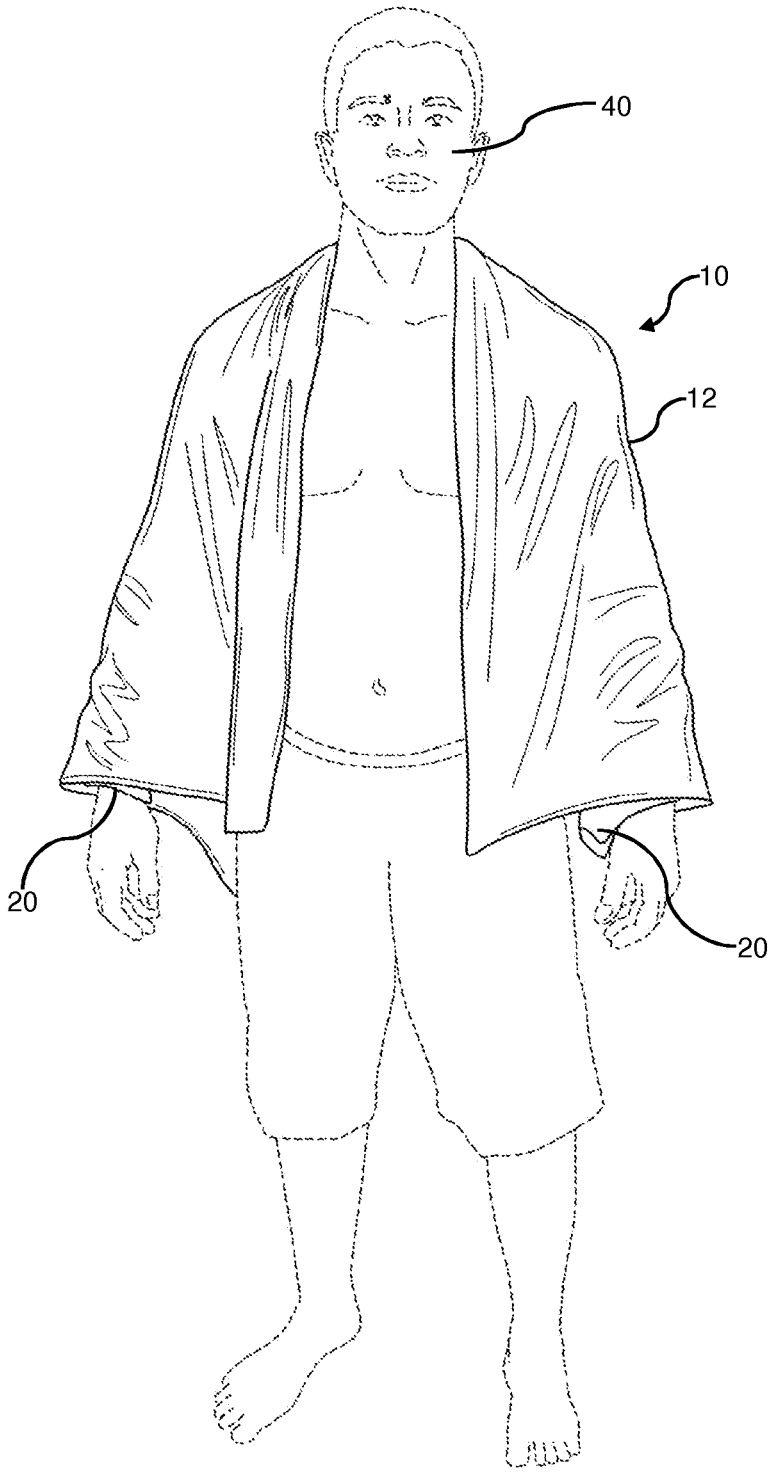
FIG. 4 illustrates a perspective view of the towel/blanket with arm channels being worn by a person.
Figure 5:
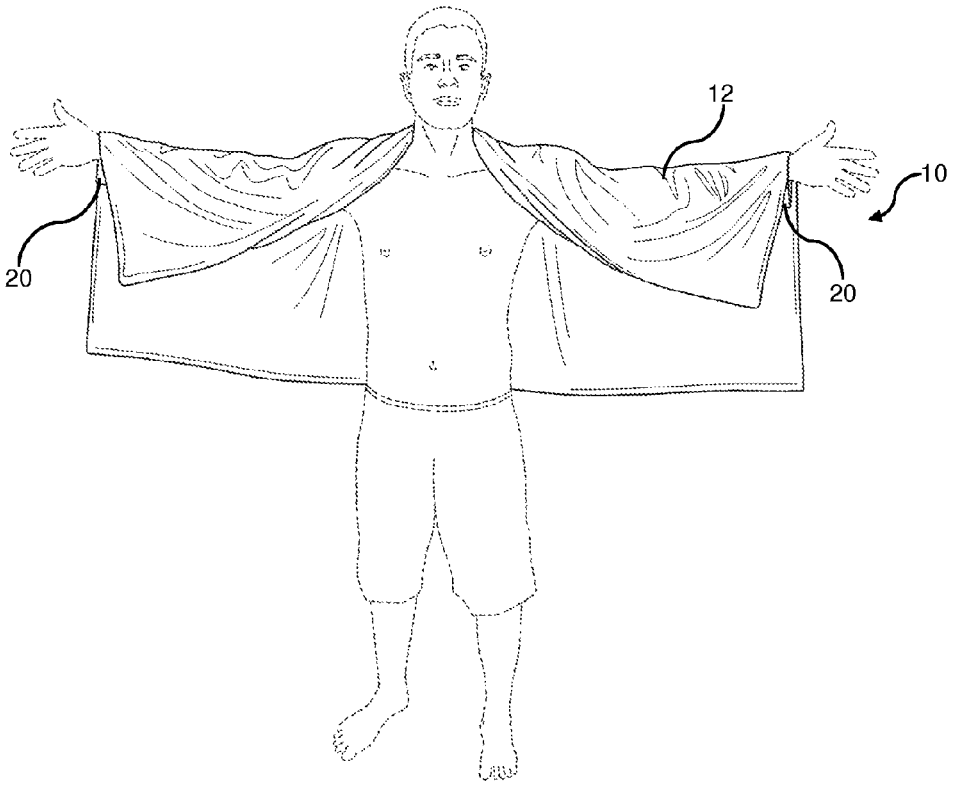
FIG. 5 illustrates a second perspective view of the towel/blanket with arm channels being worn by a person having their arms extended.

To reduce unwanted falling off of the towel/blanket 10, a person 40 inserts their arms, one each, into each of the arm channels 28, thereby positioning the point where the arm channels meet (or are closest together) 26 roughly centered on the user's back/neck with the towel/blanket 10 covering the upper torso area of the user's back, in some cases, part or all of the user's neck as shown in FIGS. 4 and 5.

To facilitate insertion of the arms of a person 40, the inner openings 28 are formed at an angle with respect to the lengthwise edge 14 of the towel/blanket 10. In some embodiments, the angle is approximately 40 degrees with respect to the lengthwise edge 14 of the towel/blanket 10. This angled opening 28 accommodates/accepts portions of the arms and shoulders of the person 40, opening wide enough for the largest anticipated person 40. The upper connections 24 meet or almost meet at an approximately lengthwise central point 26 to enable wrapping around the neck and shoulders of the user.

The arm of the person is inserted into the openings 28 and the hands of the person 40 extend out of the wrist openings 30.

Although the towel/blanket 10 is shown to be rectangular, any shape is anticipated.

Although any arc radius is anticipated, it has been found that a slight arc in lower connection 22 enables bending of the arms of the wearer 40 at the elbow.

Preferably, though not required, the upper connection 24 is at an angle with respect to the closer lengthwise edge 14 of the towel/blanket 10, angling closer to the closer lengthwise edge 14 of the towel/blanket 10 near to the point where the arm channels meet (or are closest together) 26. Although any angle is anticipated, a 6 degree slope is preferred.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A towel comprising:

a base sheet having a top lengthwise edge, a first widthwise edge and a second widthwise edge, the top lengthwise edge being longer than the first widthwise edge, the top lengthwise edge being longer than the second widthwise edge, and the first widthwise edge being substantially the same length as the second widthwise edge;

a first arm cover, a top edge of the first arm cover is linear, the top edge of the first arm cover is affixed to the base sheet, a first end of the top edge of the first arm cover is attached at a first distance from the top lengthwise edge of the base sheet nearest to a center of the base sheet and a second end of the top edge of the first arm cover is attached at a second distance from the top lengthwise edge of the base sheet nearest to the first widthwise edge of the base sheet, the first distance being less than the second distance, a bottom, arced edge of the first arm cover is affixed to the base sheet forming a first arm channel having a first shoulder opening towards the center of the base sheet and having a first wrist opening coincident with the first widthwise edge of the base sheet; and a second arm cover, a top edge of the second arm cover is linear, the top edge of the second arm cover is affixed to the base sheet, a first end of the top edge of the second arm cover is attached at the first distance from the top lengthwise edge of the base sheet nearest to the center of the base sheet and a second end of the top edge of the second arm cover is attached at the second distance from the top lengthwise edge of the base sheet nearest to the second widthwise edge of the base sheet, a bottom, arced edge of the second arm cover is affixed to the base sheet forming a second arm channel having a second shoulder opening towards the center of the base sheet and having a second wrist opening coincident with the second widthwise edge of the base sheet.

2. The towel of claim 1, wherein the base sheet, the first arm cover and the second arm cover are made from cloth.

3. The towel of claim 2, wherein the cloth is terry cloth.

4. The towel of claim 2, wherein the first arm cover is affixed to the base sheet by stitching, and the second arm cover is affixed to the base sheet by stitching.

5. The towel of claim 1, wherein the top edge of the first arm cover is affixed to the base sheet at an angle such that the second end of the top edge of the first arm cover that is furthest from the second arm cover is further from the top lengthwise edge of the base sheet than the first end of the top edge of the first arm cover, and the top edge of the second arm cover is affixed to the base sheet at an angle such that the second end of the top edge of the second arm cover that is farthest from the first arm cover is farther from the top lengthwise edge of the base sheet than the first end of the top edge of the second arm cover.

6. The towel of claim 1, wherein the second end of the top edge of the first arm cover and an end of the bottom, arced edge of the first arm cover are coincident with the first widthwise edge of the base sheet and a length of the top edge of the first arm cover is greater than a length of the bottom, arced edge of the first arm cover, thereby forming an angled shoulder opening in the first arm cover at an end of the first arm cover that is closest to the second arm cover such that the first end of the top edge of the first arm cover is closer to the center of the base sheet than is a second end of the bottom, arced edge of the first arm cover.

7. The towel of claim 1, wherein the second end of the top edge of the second arm cover and an end of the bottom, arced edge of the second arm cover are coincident with the second widthwise edge of the base sheet and a length of the top edge of the second arm cover is greater than a length of the bottom, arced edge of the second arm cover, thereby forming an angled shoulder opening in the second arm cover at an end of the second arm cover that is closest to the first arm cover such that the first end of the top edge of the second arm cover is closer to the center of the base sheet than is a second end of the bottom, arced edge of the second arm cover.

8. The towel of claim 1, wherein the base sheet, the first arm cover and the second arm cover are made from the same material.

* * * * *